United States Patent [19]

Juliano

[11] 3,998,273

[45] Dec. 21, 1976

[54] APPARATUS FOR USE WITH A FIRE SAFETY DEVICE

[75] Inventor: Richard F. Juliano, Bronxville, N.Y.

[73] Assignee: The Reliable Automatic Sprinkler Company, Inc., Mount Vernon, N.Y.

[22] Filed: Mar. 5, 1976

[21] Appl. No.: 664,360

[52] U.S. Cl. ..... 169/37; 169/42; 169/51; 169/57

[51] Int. Cl.[2] ..... A62C 37/12

[58] Field of Search ..... 169/51, 57, 37, 41, 169/42

[56] References Cited

UNITED STATES PATENTS

| | | | |
|---|---|---|---|
| 2,917,116 | 12/1959 | Wyant | 169/57 |
| 3,393,746 | 7/1968 | Hodnett | 169/42 X |
| 3,459,266 | 8/1969 | Ault | 169/41 X |
| 3,633,676 | 1/1972 | Gloeckler | 169/41 X |
| 3,714,989 | 2/1973 | Gloeckler | 169/42 X |
| 3,727,695 | 4/1973 | Danton | 169/37 |

*Primary Examiner*—Robert S. Ward, Jr.
*Attorney, Agent, or Firm*—Brumbaugh, Graves, Donohue & Raymond

[57] ABSTRACT

Apparatus for use with a fire safety device such as a sprinkler has fusible means for attaching one or more magnets to a non-magnetic first member or escutcheon. The magnets may also hold the escutcheon to a magnetic second member such as a housing for the sprinkler until heat, as from a fire, melts the fusible material to release the escutcheon from the magnet.

15 Claims, 3 Drawing Figures

APPARATUS FOR USE WITH A FIRE SAFETY DEVICE

BACKGROUND OF THE INVENTION

This invention relates to a fire safety device and, more particularly, to apparatus for use therewith having fusible means attaching a magnet to one member for magnetically holding the one member to another member until heat melts the fusible material.

Many fire safety devices are well known. Sprinklers and fire doors are examples of fire safety devices with which the present invention has particular utility. A sprinkler will be used to illustrate the invention, it being understood from the outset that the invention may also be used with other fire safety devices such as, for example, the fire doors, a heat sensor, and a heat activated alarm signal.

Known sprinklers have a compound head assembly for discharging and dispersing a fire extinguishing agent supplied from a pipe coupled to the head assembly when heat from a fire opens a normally closed valve in the sprinkler head assembly. Such sprinklers often have a gear-like dispersing member in spaced alignment with the valve in the sprinkler for dispersing the extinguishing agent. This structure, although desirable for discharging and dispersing the fire extinguishing agent during the extraordinary conditions of a fire, also gives the sprinkler an unusual, protruding appearance. The usual placement of such sprinklers on ceilings or walls of a structure makes them conspicuous and their unusual appearance, therefore, undesirable.

The structure and the placement of the sprinklers also makes them difficult to clean. For example, the usual placement of the sprinklers makes it difficult to paint the adjacent ceiling or wall without also painting the sprinkler. Paint on the sprinkler may interfere with its operation. Cleaning paint from the sprinkler, however, is difficult both because of its compound structure and because of its placement. Cleaning the sprinkler also runs the risk of accidentally opening the valve for discharging the fire extinguishing agent. The agent then causes unnecessary water (or other fire extinguishing agent) damage to the structure.

Many specialized structures are intended to provide a highly clean, sterile environment for, for example, sensitive manufacturing processes or health care. It is often desired to wash such structures with dust-removing or disinfectant solutions. These solutions are difficult satisfactorily to apply to the compound structure of the sprinkler.

For all of these and other reasons, it is often desired to recess the sprinkler in the ceiling, wall, or other structure adjacent which it is mounted and cover the recessed sprinkler with an escutcheon. The escutcheon is desirably substantially flush and close-fitting with structure adjacent which the sprinkler is mounted. Although the escutcheon provides a neat appearance, and may be readily cleaned, disinfected, and freed of encumbering paint, means must still be provided for permitting the operation of the sprinkler during the extraordinary conditions of a fire.

One U.S. patent suggests an escutcheon which is entirely formed of fusible material such as solder. The heat of a fire is supposed to melt the escutcheon from the sprinkler and then activate the sprinkler. Another U.S. patent suggests attaching an escutcheon with coil springs extending to clips which are attached to the escutcheon by a fusible material. Heat from a fire is supposed to melt the fusible material to release the clips from the escutcheon and thereby permit the escutcheon to fall from the sprinkler.

Another safety device with which the present invention has particular utility is a fire safety door. Such doors often have a spring which tends to close the door. The spring is normally restrained from closing the door by an electromagnetic latch. During a fire, heat responsive means cut-off the electric power to the electromagnetic latch to release the spring for closing the door. If, however, the heat responsive means fails to cut-off the electric power or the electromagnetic device has acquired sufficient residual magnetization to continue to hold the door against the spring, the door will fail to close. It is therefore desirable to provide an additional safety device at each fire door which, under extraordinary heat at the door, will alternatively release the electromagnetic latch to permit the spring to close the door. It may be desired, of course, to also cover the door closing mechanism with an escutcheon.

SUMMARY OF THE INVENTION

It is therefore an object of the invention to provide a fire safety device with apparatus for holding one member to another which apparatus both responds to heat to release the members from each other and also responds readily to other means for releasing the members from each other. A preferred form of the apparatus magnetically holds an escutcheon over a recessed fire safety device.

The apparatus for use with the fire safety device has one or more magnets and fusible means for attaching each magnet to a non-magnetic first member. Either one or both of at least part of the fusible means or a second member is magnetic. The magnet then magnetically holds the first member to the second member until heat, as from a fire, melts the fusible means to release the first member from the magnet and thereby release the first member from the second member.

The first member may also be released readily from the second member merely by breaking the magnetic attachment between the magnet and the second member or the fusible means. For example, the first member may be merely pulled from the second member by a force stronger than the magnetic attachment of the members. Alternatively, when the magnet is an electromagnet, the members may be separated by merely cutting-off the electric power to the electromagnet. Reattachment of the members then requires that they merely be repositioned for magnetic attachment.

The ease with which the members may be separated and reconnected is an important advantage of the invention. For example, by proper design selection of the magnetic strength of the magnet, mere hand strength may separate the members without the use of any tools. Reattachment is similarly accomplished by merely repositioning the members. When, for example, the first member is an escutcheon over a recessed sprinkler, the escutcheon then can be removed by hand, the sprinkler inspected, and the escutcheon replaced by merely repositioning it over the sprinkler. No rivets, clips, springs, or other fasteners have to be disassembled and then reassembled for separating and reassembling the members.

In addition to such easy manual separation of the members, the members also separate in response to heat from a fire. The heat melts fusible material in the fusible means attached to the magnet to release the non-magnetic first member from the magnet and second member. Returning to the example in which the first member is an escutcheon magnetically held over a recessed sprinkler, proper selection of a fusible material with a desired melting temperature below that at which the sprinkler operates permits heat from a fire to melt the fusible material first. The escutcheon then falls from the sprinkler and the heat from the fire activates the sprinkler in the known manner.

The magnetic attachment of the escutcheon over the sprinkler additionally cooperates with the sprinkler in that, if the fusible material should fail to release the escutcheon, the heat from the fire may penetrate the escutcheon and still activate the sprinkler in the known manner. The sprinkler then discharges the fire extinguishing agent onto the escutcheon to mechanically separate the escutcheon from the second member with its weight and discharge force. It is thereby assured that a mere escutcheon will not prevent the important, fire-extinguishing operation of the sprinkler.

Although a recessed sprinkler has been extensively used above to exemplify the invention, the invention also has utility with other fire safety devices. For example, the recessed sprinkler may be replaced by a recessed heat sensor or alarm signal with an escutcheon magnetically held over the recessed sensor or signal.

A fire door is a further example of the fire safety devices with which the invention has utility. Such a door may have an electromagnetic latch which prevents a spring from closing the fire door. The non-magnetic first member is then a portion of the electromagnetic latch which is held to a second portion of the latch, the second member, by a magnet attached to the first portion with fusible means. Then, if the electromagnetic latch should fail to operate, heat from a fire near the door will melt the fusible material to release the first member from the second member and thereby release the door latch. The spring may then close the door just as though the electromagnetic latch had operated properly.

The invention may also be used with other fire safety devices in such embodiments as may occur to those skilled in the art. It is not intended that the invention be limited by any of the specific examples given herein, but only by the claims at the conclusion hereof.

DESCRIPTION OF THE DRAWINGS

Preferred embodiments which are intended to further illustrate but not to limit the invention will now be described with reference to drawings in which.

DESCRIPTION OF ONE PREFERRED EMBODIMENT

Figure 1:
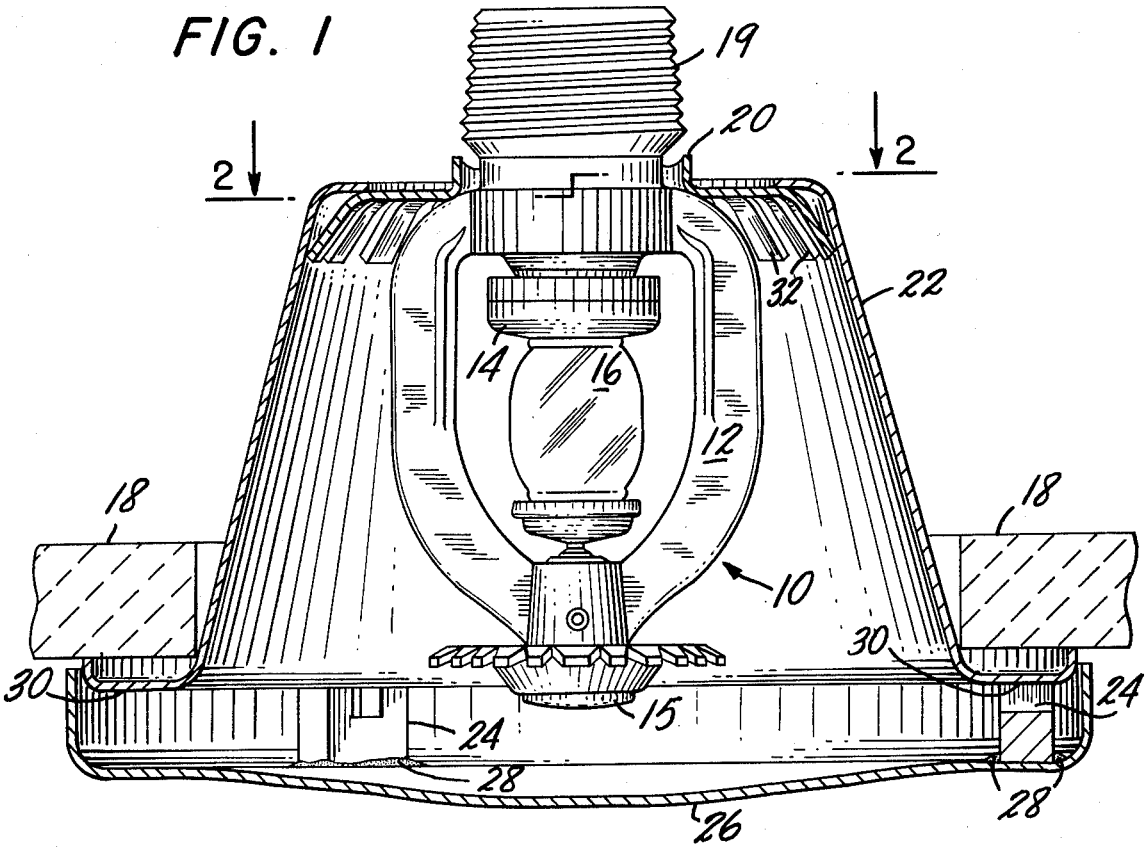
FIG. 1 is an elevation, partly in section, of an embodiment of the invention for use with a recessed sprinkler.

The preferred embodiment shown in FIG. 1 is intended for use with a sprinkler 10. The sprinkler may be of any of the many known designs. In general, such sprinklers have a frame 12 extending between a cap 14 over an opening for discharging fire extinguishing fluid and a dispersing member 15 opposite the opening for dispersing the fluid. A fusible member 16 forms part of a retaining structure which extends between the cap and a portion of the frame adjacent the dispersing member for normally holding the cap over the opening. When heat from a fire melts the fusible member 16, it releases the cap to permit the discharge of the fire extinguishing fluid.

The sprinkler 10 is mounted in spaced, recessed relation to a structure 18 adjacent the sprinkler at an opening in the structure. For example, the sprinkler may be supported by a threaded connector 19 received in a pipe (not shown) for supplying the fire extinguishing fluid to the sprinkler. The structure 18 may be a ceiling.

A spring member 20 extends about and is supported on an upper portion of the sprinkler 10. A cup-shaped housing member 22 is supported on the spring member 20 and extends to edge portions of the opening in the structure 18.

Magnets 24 are attached to a peripherial portion of an escutcheon 26 with a fusible material 28 such as solder. The escutcheon is positioned over the housing member 22 and dimensioned such that the magnets 24 engage a flat surface of an edge portion 30 of the housing member 22.

The escutcheon 26 is made from a non-magnetic material so that only the fusible material 28 but not the magnetism of the magnets 24 holds the magnets on the escutcheon. At least the portion 30 of the housing member 22 is made from a magnetic material so that the magnets 24 magnetically hold the escutcheon to the housing member. As now described, the escutcheon may be identified as the first member of the invention and the housing member 22 may be identified as the second member.

Figure 2:
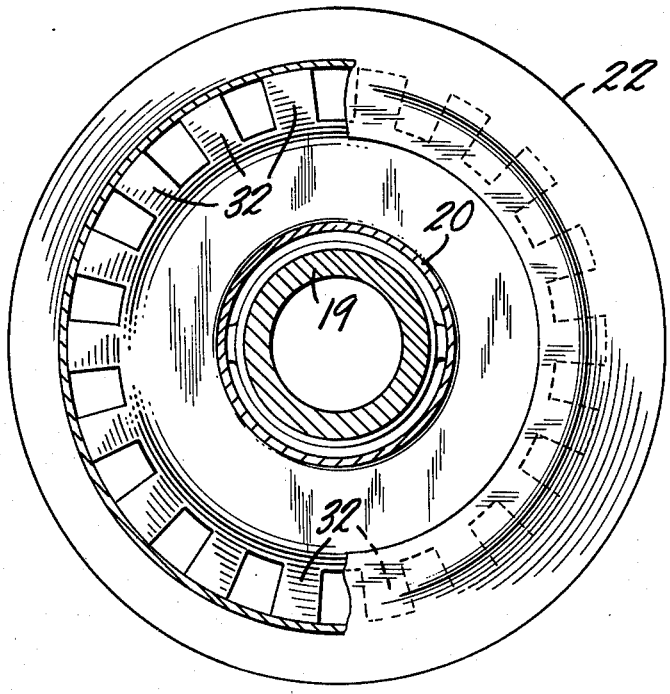
FIG. 2 is a top view of the embodiment shown in FIG. 1 with a portion thereof cut away.

As better seen in FIG. 2, resilient fingers 32 extend about the spring member 20. As shown in FIG. 1, the fingers engage sides of the housing member 22. The fingers 32 resiliently urge the housing member 22 upward of the sprinkler in the orientation shown in FIG. 1. The resilient upward-urging of the housing member 22 continually positions edges of the magnetic portion 30 of the housing member and thus the escutcheon adjacent the structure 18.

DESCRIPTION OF ANOTHER PREFERRED EMBODIMENT

Figure 3:
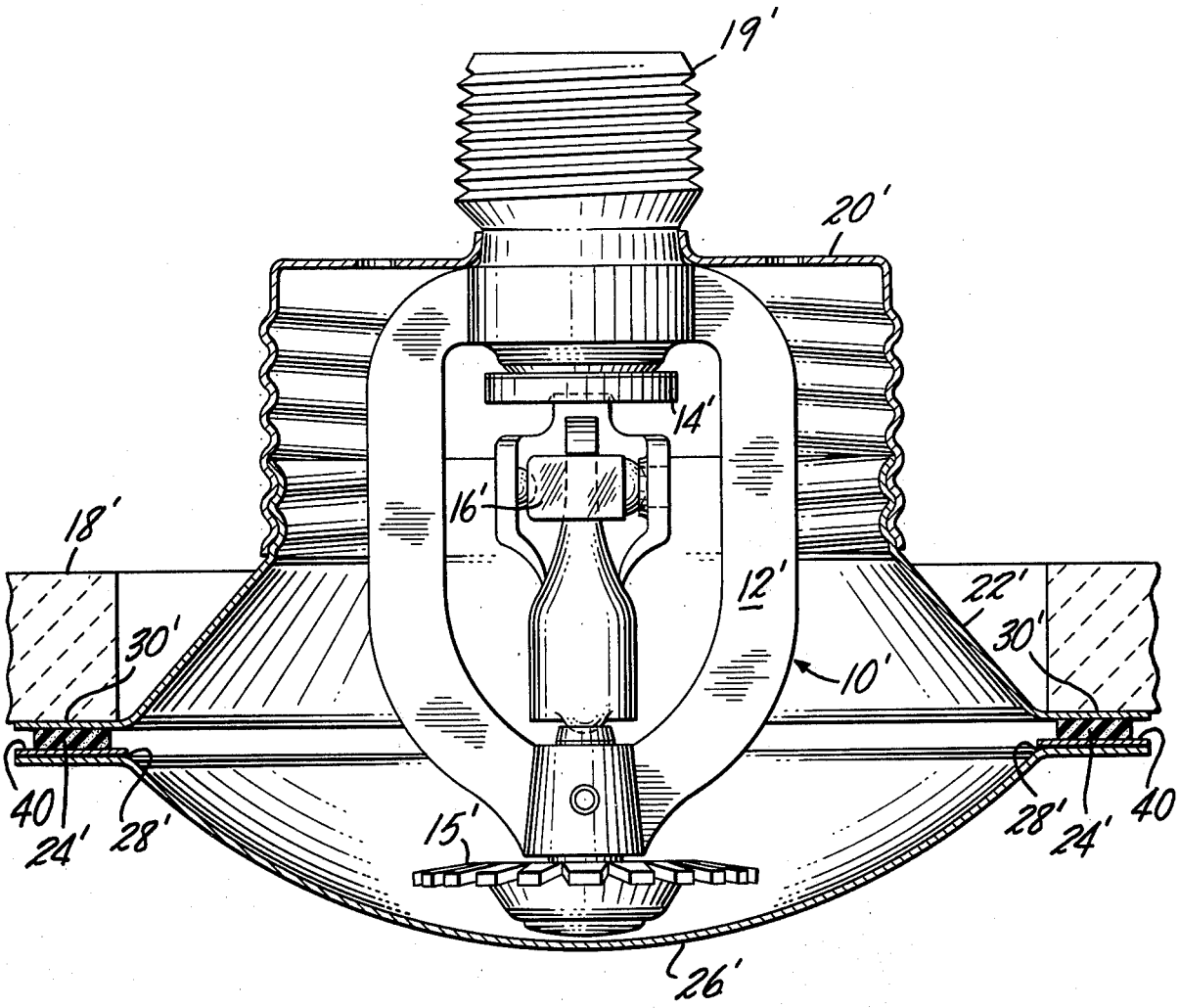
FIG. 3 is an elevation, partly in section, of another embodiment of the invention for use with a recessed sprinkler.

FIG. 3 shows another preferred embodiment of the invention with another recessed sprinkler 10'. The sprinkler 10', although somewhat different from the sprinkler 10 (FIG. 1), has a frame 12' extending between an opening for discharging fire extinguishing fluid and a dispersing member 15' for dispersing the fire extinguishing fluid. A structure extending across the frame for normally retaining a cap 14' over the opening includes a member 16' having a fusible element (not shown) for releasing the structure when heat from a fire melts the fusible element. The sprinkler may be connected to a pipe (not shown) for supplying fire extinguishing fluid by a threaded portion 19'.

The member 20' differs from the member 20 (FIG. 1) by having a downwardly-extending, peripheral, threaded portion. A corresponding threaded portion on the housing member 22' engages the threaded portion on the member 20' for supporting the housing member. A generally flat portion 30' of the housing member is then positioned adjacent the structure 18', such as a ceiling, which defines an opening in which the sprinkler is recessed.

The magnets 24′ are flat strips made from a commercially available magnetic rubber material rather than the generally U-shaped magnets 24 (FIG. 1) which, for example, may be metallic. The rubber magnets 24′ cannot be readily attached to escutcheon 26′ with fusible material 28′ such as solder.

The structure shown in FIG. 3 therefore differs from the structure shown in FIG. 1 by including a magnetic attachment plate 40 which magnetically adheres to the magnets 24′ on a side of the magnets opposite from that attached to the portion 30′ of the housing member. The attachment plates 40 may be made from metal or other material suitable for attachment to the escutcheon by the fusible material 28′ (as well as magnetically attached to the magnets). In another embodiment (not shown) the fusible material itself may be magnetic.

In these embodiments the magnets 24′ magnetically hold the magnetic part of the fusible means (the attachment plates 40 in FIG. 3) for manual or heat separation. The magnets may also magnetically attach to a magnetic portion 30′ of the housing but, in view of the magnetic attachment to the fusible means, the magnets may alternatively be fastened to the housing with a fastener (not shown). The escutcheon 26′, like the escutcheon 26 (FIG. 1), is, of course non-magnetic so that melting of the fusible material 28′ will release the escutcheon from the housing member, the magnets and the attachment plates then being retained on the housing member. Alternatively, the escutcheon 26′ can be pulled from the housing member, the magnets 24′ then being magnetically retained on either the housing member or the attachment plates for ready re-attachment of the escutcheon. The structure shown in FIG. 3 has advantage over the structure shown in FIG. 1 in that the rubber magnets 24′ may be made thinner than the generally U-shaped magnets 24 (FIG. 1) to provide a more pleasing (more flush) profile between the escutcheon and the adjacent structure 18′.

OPERATION

When heat from a fire reaches the escutcheon 26, 26′ it melts the fusible material 28, 28′. This releases the escutcheon from the magnets 24, 24′. The escutcheon then falls from the sprinkler. The heat from the fire then activates the sprinkler in the known manner, the magnets 24, 24′ (and attachment plates 40) which are retained on the housing member 22, 22′ being sufficiently small so as not to interfere with the desired dispersal of the fire extinguishing fluid from the sprinkler.

With the escutcheon 26, 26′ magnetically held over the sprinkler as shown in FIGS. 1 and 3, the escutcheon may be separated from the housing member 22, 22′ by merely pulling it hard enough to break the magnetic attachment between the escutcheon and the housing member. Proper selection of the magnetic strength of the magnets permits this to be done by hand, without any tools.

With the escutcheon removed, the sprinkler may be inspected or serviced from the room beneath the structure 18. After the inspection or servicing of the sprinkler, the escutcheon 26, 26′ may be replaced by merely repositioning it relative to the housing member 22, 22′. The magnets then hold the escutcheon to the housing member as before. No tools are thus required for installing or replacing the escutcheon.

I claim:

1. Apparatus for use with a fire safety device, the apparatus comprising: a non-magnetic first member; a second member; a magnet between the members; fusible means for attaching the magnet to the first member; and means for attaching the magnet to the second member, at least one of the second member and part of the fusible means being magnetic whereby the magnet magnetically holds the first member to the second member until heat, as from a fire, melts at least part of the fusible means to release the first member from the magnet and, thereby, from the second member.

2. Apparatus as set forth in claim 1 wherein the fire safety device is a sprinkler.

3. Apparatus as set forth in claim 1 wherein the fire safety device is recessed within an opening in a structure adjacent the fire safety device and wherein the first member is an escutcheon positioned over the opening.

4. Apparatus as set forth in claim 3 wherein the second member is a housing member extending about the opening, and additionally comprising means for supporting the housing member from the fire safety device.

5. Apparatus as set forth in claim 1 wherein the fusible means comprise a fusible material attaching the magnet to the first member.

6. Apparatus as set forth in claim 5 wherein the magnet is metallic.

7. Apparatus as set forth in claim 5 wherein the second member is magnetic and the means for attaching the magnet to the second member is the magnet and magnetic second member.

8. Apparatus as set forth in claim 1 wherein the fusible means is at least partly magnetic to be magnetically held to the magnet.

9. Apparatus as set forth in claim 8 wherein the fusible means comprise a magnetic attachment plate magnetically held to the magnet on a side thereof opposite the second member and fusible material attaching the attachment plate to the first member.

10. Apparatus as set forth in claim 9 wherein the magnet is rubber.

11. Apparatus as set forth in claim 8 wherein the second member is magnetic and the means for attaching the magnet to the second member is the magnet and magnetic second member.

12. Apparatus as set forth in claim 8 wherein the means for attaching the magnet to the second member is a fastener.

13. Apparatus for use with a fire safety device recessed in an opening in a structure adjacent the device, the apparatus comprising:

a non-magnetic escutcheon over the opening; magnets; fusible material attaching the magnets to spaced, peripheral portions of the escutcheon; and a housing member supported from the fire safety device and extending about the opening, at least part of the housing member at edges of the opening being magnetic for magnetic attachment to the magnets whereby the escutcheon may be pulled from the housing and reattached merely by repositioning it, and released from the housing member by heat, as from a fire, which melts the fusible material.

14. Apparatus for use with a fire safety device recessed in an opening in a structure adjacent the device, the apparatus comprising:

a non-magnetic escutcheon over the opening; generally flat, strip magnets; a housing member supported from the fire safety device and extending about the opening, at least part of the housing at edges of the opening being magnetic for magnet attachment to one side of the magnets; an attachment plate magnetically held to the other side of each magnet; and fusible material attaching each attachment plate to the escutcheon whereby the escutcheon may be pulled from the housing and reattached merely by repositioning it, and released from the housing member by heat, as from a fire, which melts the fusible material.

15. Apparatus for use with a fire safety device recessed in an opening in a structure adjacent the device, the apparatus comprising:

a non-magnetic escutcheon over the opening; at least partly magnetic fusible means on the escutcheon for melting by heat; at least one magnet magnetically held to the fusible means; a housing member supported from the fire safety device; and fastening means for attaching the housing member to the magnet whereby the escutcheon may be pulled from the housing member and reattached merely by repositioning it, and released from the housing member by heat, as from a fire, which melts the fusible means.

* * * * *

UNITED STATES PATENT AND TRADEMARK OFFICE

CERTIFICATE OF CORRECTION

PATENT NO. : 3,998,273

DATED : December 21, 1976

INVENTOR(S) : Richard F. Juliano

It is certified that error appears in the above-identified patent and that said Letters Patent are hereby corrected as shown below:

Col. 4, line 53, "extinghising" should read -- extinguishing --;

Col. 5, line 25, after "course" add -- , --; and

Col. 7, line 2, "magnetic for magnet" should read -- magnetic for magnetic --.

Signed and Sealed this

Fourteenth Day of June 1977

[SEAL]

*Attest:*

RUTH C. MASON
*Attesting Officer*

C. MARSHALL DANN
*Commissioner of Patents and Trademarks*